US006412709B1

(12) United States Patent
Sugiura

(10) Patent No.: US 6,412,709 B1
(45) **Date of Patent: *Jul. 2, 2002**

(54) FLUID MIXING-JETTING APPARATUS, FLUID MIXER AND SNOWMAKER

(75) Inventor: Hikoroku Sugiura, Funabashi (JP)

(73) Assignee: Shinyou Technologies Inc., Chiba (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,256

(22) Filed: Mar. 24, 1999

(30) Foreign Application Priority Data

| | | |
|---|---|---|
| Mar. 25, 1998 | (JP) | 10-096599 |
| Apr. 16, 1998 | (JP) | 10-122799 |
| Nov. 24, 1998 | (JP) | 10-332372 |

(51) Int. Cl.[7] ..... B05B 1/34

(52) U.S. Cl. ..... 239/432; 239/451; 239/453; 239/456; 239/499; 239/524; 239/491; 222/145.6; 366/175.2

(58) Field of Search ..... 239/489, 490, 239/491, 494, 518, 432, 524, 521, 589, 596, 599, 601, 463, 499, 500, 504, 523, 492, 493, 496, 431, 2.2, 14.2; 222/145.6

(56) References Cited

U.S. PATENT DOCUMENTS

| | | | | | |
|---|---|---|---|---|---|
| 436,942 | A | * | 9/1890 | Scheen | 239/524 |
| 693,938 | A | * | 2/1902 | Witt | 239/499 |
| 858,811 | A | * | 7/1907 | Hull | 239/599 X |
| 1,063,913 | A | * | 6/1913 | Cornelius | 239/599 X |
| 1,109,272 | A | * | 9/1914 | Wierum | 239/500 |
| 1,276,245 | A | * | 8/1918 | Millard et al. | 239/596 X |
| 1,339,349 | A | * | 5/1920 | Kahler | 239/596 |
| 1,364,424 | A | * | 1/1921 | Baker | 239/524 |
| 1,972,955 | A | * | 9/1934 | Saugman | 239/432 X |
| 2,536,832 | A | * | 1/1951 | Altorfer | 239/491 |
| 3,829,013 | A | * | 8/1974 | Ratnik | 239/431 X |
| 3,908,903 | A | | 9/1975 | Burns | |
| 3,923,253 | A | * | 12/1975 | Stewart | 239/599 X |
| 4,196,857 | A | * | 4/1980 | Bauer | 239/589 X |
| 4,343,434 | A | * | 8/1982 | Haruch | 239/432 |
| 4,712,921 | A | | 12/1987 | Sugiura | |
| 4,793,554 | A | | 12/1988 | Kraus et al. | |
| 5,409,672 | A | * | 4/1995 | Certinkaya | 239/500 X |
| 5,779,361 | A | | 7/1998 | Sugiura | |

FOREIGN PATENT DOCUMENTS

| | | | |
|---|---|---|---|
| GB | 2096911 | | 10/1982 |
| JP | 59-11835 | | 5/1984 |
| JP | 07198238 | | 8/1995 |
| JP | 8-510041 | | 10/1996 |
| JP | 9299776 | * | 9/1997 |
| TW | 358039 | | 5/1999 |
| WO | WO/9423254 A1 | | 10/1994 |

* cited by examiner

*Primary Examiner*—Lesley D. Morris
*Assistant Examiner*—Robin O. Evans
(74) *Attorney, Agent, or Firm*—Bachman & LaPointe, P.C.

(57) ABSTRACT

A fluid mixing-jetting apparatus includes an apparatus body provided at its upstream end with an inlet arrangement for introducing plural kinds of fluids into a flow passage formed in the apparatus body. The apparatus further includes an end plate closing a downstream end of the flow passage of the apparatus body. The end plate is formed with at least one jet opening at a position offset from a center axis of the flow passage of the apparatus body. The end plate may be further formed with a plurality of concave portions on an upstream surface thereof so that the upstream surface of the end plate is formed as a non-planar surface. The jet opening may be non-circular and continuous with an inner circumference of the apparatus body defining the flow passage.

12 Claims, 15 Drawing Sheets

FLUID MIXING-JETTING APPARATUS, FLUID MIXER AND SNOWMAKER

BACKGROUND OF THE INVENTION

1. Field of the Invention

The present invention relates to a fluid mixing-jetting apparatus, a fluid mixer and a snowmaker.

2. Description of the Related Art

A conventional fluid mixing-jetting apparatus of one type comprises an apparatus body having an inlet arrangement for introducing plural kinds of compressed fluids into a flow passage formed in the apparatus body and a jet outlet provided on a center axis of the flow passage of the apparatus body for jetting a fluid mixture therethrough. However, there has been a problem that the high jet pressure is required for enhancing the mixing efficiency. Thus, the apparatus becomes large in size and requires the high operation power.

A conventional fluid mixer of one type comprises an apparatus body having an inlet arrangement for introducing plural kinds of compressed fluids into a flow passage formed in the apparatus body, an outlet for discharging a fluid mixture therethrough and a twist vane type static mixer provided in the flow passage between the inlet arrangement and the outlet. However, there has been a problem that the static mixer causes a large pressure loss when the mixing efficiency is increased, and further that the mixing efficiency is still not satisfactory.

On the other hand, a snowmaker of a snow gun type which can efficiently produce snow even at a relatively high open air temperature has been demanded. A conventional snow gun type snowmaker comprises an apparatus body having an inlet arrangement for Introducing compressed air and water into a flow passage formed in the apparatus body, and a jet outlet provided on a center axis of the flow passage of the apparatus body for jetting an air-water mixture therethrough, wherein the inlet arrangement includes an ejector structure for jetting the air into the flow passage. Upon jetting of the air-water mixture, the pressure of the compressed air (about 7 $Kg/cm^2$) is released so that a low temperature area of about −40° C. is obtained. Accordingly, the jetted waterdrops are frozen to be ice crystals through adiabatic cooling so that artificial snow is obtained.

However, the foregoing conventional snow gun type snowmaker requires a large amount of high-pressure compressed air and thus a large-size compressor with high power consumption, thereby leading to high costs.

SUMMARY OF THE INVENTION

Therefore, it is an object of the present invention to provide a fluid mixing-jetting apparatus which can improve the mixing efficiency thereof without increasing the jet pressure.

It is another object of the present Invention to provide a fluid mixer which can improve the mixing efficiency thereof without increasing a pressure loss caused at a static mixer.

It is another object of the present invention to provide a snowmaker which can easily and efficiently make artificial snow of excellent quality even at a relatively high open air temperature.

According to one aspect of the present invention, there is provided a fluid mixing-jetting apparatus comprising an apparatus body provided at its upstream end with an inlet arrangement for introducing plural kinds of fluids into a flow passage formed in the apparatus body; and an end plate closing a downstream end of the flow passage, the end plate formed with a jet opening at a position offset from a center axis of the flow passage.

It may be arranged that the end plate is further formed with a plurality of concave portions on an upstream surface thereof so as to form the upstream surface of the end plate as a non-planar surface.

It may be arranged that the jet opening is non-circular and continuous with an inner circumference of the apparatus body at the downstream end of the flow passage.

According to another aspect of the present invention, there is provided a fluid mixer comprising an apparatus body provided at its upstream end with an inlet arrangement for introducing plural kinds of fluids into a flow passage formed in the apparatus body; a static mixer provided in the flow passage downstream of the inlet arrangement; and a collision plate provided in the flow passage downstream of the static mixer, the collision plate having a non-circular ejection opening at an offset position thereof.

It may be arranged that the flow passage has a diameter-increased passage portion in which the static mixer is provided, the diameter-increased passage portion having a passage sectional area which is greater than that of the flow passage upstream of the diameter-increased passage portion.

It may be arranged that a downstream side of the collision plate is released.

It may be arranged that a downstream side of the collision plate has a diameter-increased passage portion whose diameter is greater than that of the flow passage downstream of the static mixer, the diameter-increased passage portion extending a given distance in a flow direction of the fluids.

It may be arranged that the static mixer comprises another collision plate disposed perpendicular to a flow direction of the fluids and a circumferential wall projecting in an upstream direction from a rim of the another collision plate.

According to another aspect of the present invention there is provided a fluid mixer comprising an apparatus body provided at its upstream end with an inlet arrangement for introducing plural kinds of fluids into a flow passage formed in the apparatus body; a static mixer provided in the flow passage, the static mixer comprising a collision plate disposed perpendicular to a flow direction of the fluids and a circumferential wall projecting in an upstream direction from a rim of the collision plate; and a fixing disk closing a space between an outer circumference of the static mixer and an inner circumference of the apparatus body defining the flow passage, the fixing disk having a non-circular ejection opening at an offset position thereof.

According to another aspect of the present invention, there is provided a fluid mixer comprising an apparatus body provided at its upstream end with an inlet arrangement for introducing plural kinds of fluids into a flow passage formed in the apparatus body; and a static mixer provided in the flow passage, the static mixer comprising a collision plate disposed perpendicular to a flow direction of the fluids and a circumferential wall projecting in an upstream direction from a rim of the collision plate, wherein the flow passage has a downstream passage portion whose diameter is smaller than that of the flow passage upstream of the downstream passage portion, the downstream passage portion having an upstream extended portion hermetically extended into the flow passage and hermetically closed at its upstream end by the collision plate, and wherein the upstream extended portion is formed with a non-circular ejection opening at the upstream end thereof.

According to another aspect of the present invention, there is provided a fluid mixer comprising an apparatus body provided at its upstream end with an inlet arrangement for introducing plural kinds of fluids into a flow passage formed in the apparatus body, the flow passage having a diameter-increased passage portion comprising a diameter-increasing step and a diameter-decreasing step; and a static mixer provided in the diameter-increased passage portion, the static mixer comprising a collision plate disposed perpendicular to a flow direction of the fluids and a circumferential wall projecting in an upstream direction from a rim of the collision plate, wherein at least one of an upstream end and a downstream end of the circumferential wall is located close to corresponding one of the diameter-increasing step and the diameter-decreasing step to provide a small gap therebetween.

According to another aspect of the present invention, there is provided a fluid mixer comprising an apparatus body provided at its upstream end with an inlet arrangement for introducing plural kinds of fluids into a flow passage formed in the apparatus body, the flow passage having a diameter-increased passage portion comprising a diameter-increasing step and a diameter-decreasing step; and a static mixer provided in the diameter-increased passage portion, the static mixer comprising a collision plate disposed perpendicular to a flow direction of the fluids and a circumferential wall projecting in an upstream direction from a rim of the collision plate, wherein one of an upstream end and a downstream end of the circumferential wall is in contact with corresponding one of the diameter-increasing step and the diameter-decreasing step, and wherein a concave portion is formed on the corresponding one of the diameter-increasing step and the diameter-decreasing step at a contact portion thereof with the circumferential wall.

According to another aspect of the present invention, there is provided a snowmaker comprising an apparatus body provided at its upstream end with an inlet arrangement for introducing compressed air and water into a flow passage formed in the apparatus body; and a static mixer provided in the flow passage downstream of the inlet arrangement.

It may be arranged that the flow passage has a diameter-increased passage portion downstream of the inlet arrangement, and that the static mixer is disposed in the diameter-increased passage portion and comprises a collision plate having a diameter approximate to a diameter of the flow passage upstream of the diameter-increased passage portion.

It may be arranged that the flow passage has a jet-side passage portion downstream of the diameter-increased passage portion, and that a downstream end of the jet-side passage portion is closed by an end plate which is formed with a non-circular jet opening at a position offset from a center axis of the flow passage, the non-circular jet opening being continuous with an inner circumference of the apparatus body defining the jet-side passage portion.

It may be arranged that the snowmaker further comprises an open-air suction inhibiting cover disposed around the non-circular jet opening and opened In a jet direction of the compressed air and water via the non-circular jet opening.

It may be arranged that the open-air suction inhibiting cover has a funnel shape.

According to another aspect of the present invention, there is provided a snowmaker comprising an apparatus body provided at its upstream end with an inlet arrangement for introducing compressed air and water into a flow passage formed in the apparatus body, the flow passage having a jet-side passage portion; and an end plate closing a downstream end of the jet-side passage portion, the end plate formed with a jet opening at a position offset from a center axis of the flow passage.

It may be arranged that the jet opening is non-circular and continuous with an inner circumference of the apparatus body defining the jet-side passage portion.

It may be arranged that the snowmaker further comprises a static mixer provided in the flow passage downstream of the inlet arrangement.

According to another aspect of the present invention, there is provided a snowmaker comprising an apparatus body for mixing compressed air and water and jetting the mixed compressed air and water via a jet opening; and an open-air suction inhibiting cover disposed around the jet opening, the open-air suction inhibiting cover opened in a jet direction of the mixed compressed air and water via the jet opening.

It may be arranged that the open-air suction inhibiting cover has a funnel shape.

According to another aspect of the present invention, there is provided a snowmaker comprising an apparatus body provided at its upstream end with an inlet arrangement for introducing compressed air and water into a flow passage formed in the apparatus body, the flow passage having a diameter-increased passage portion downstream of the inlet arrangement, the diameter-increased passage portion having an upstream diameter-increasing step; a collision plate provided in the diameter-increased passage portion, the collision plate having a diameter approximate to a diameter of the flow passage upstream of the diameter-increased passage portion: a circumferential wall projecting in an upstream direction from a rim of the collision plate: an end plate closing a downstream end of a jet-side passage portion of the flow passage, the jet-side passage portion located downstream of the diameter-increased passage portion, the end plate formed with a jet opening at a position offset from a center axis of the flow passage: and a collision plate moving mechanism associated with the collision plate for adjusting a gap between an upstream end of the circumferential wall and the upstream diameter-increasing step of the diameter-increased passage portion.

It may be arranged that the snowmaker further comprises a compressed air feed amount adjusting apparatus for adjusting an amount of the compressed air to be introduced into the flow passage via the inlet arrangement, and a compressed water feed amount adjusting apparatus for adjusting an amount of the compressed water to be introduced into the flow passage via the inlet arrangement.

It may be arranged that the snowmaker further comprises an open air temperature gauge, an open air hygrometer and a controller which controls the collision plate moving mechanism, the compressed air feed amount adjusting apparatus and the compressed water feed amount adjusting apparatus based on measured values of the open air temperature gauge and the open air hygrometer.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings.

Figure 1:
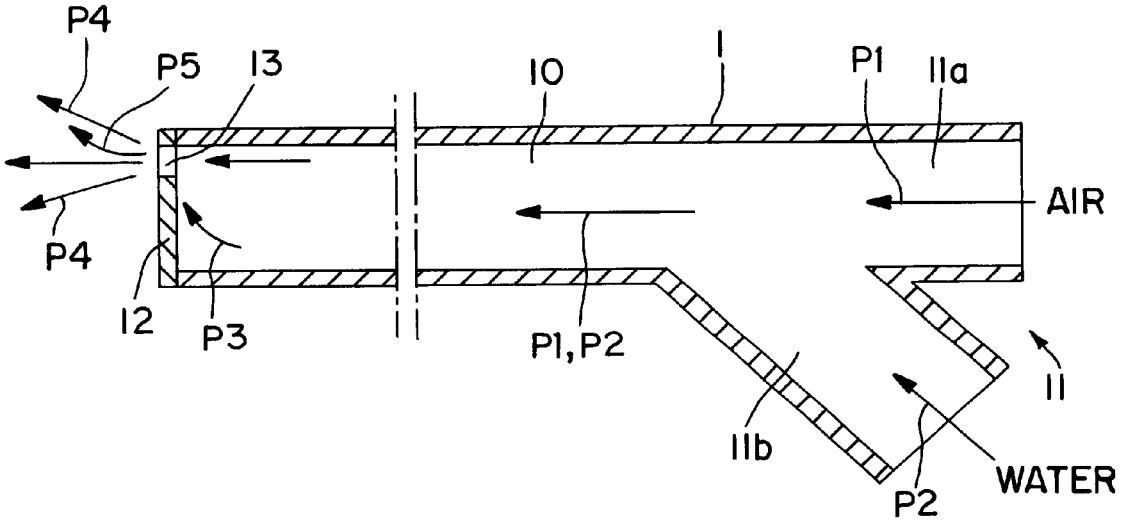
FIG. 1 is a longitudinal sectional view showing the main part of fluid mixing-jetting apparatus according to a first preferred embodiment of the present invention.

Referring to FIG. 1, a fluid mixing-jetting apparatus according to the first preferred embodiment of the present invention will be described. In FIG. 1, the fluid mixing-jetting apparatus comprises an apparatus body 1. The apparatus body 1 is provided at its upstream end with an inlet arrangement 11 for introducing plural kinds of compressed fluids into a flow passage 10 formed in the apparatus body 1.

In this embodiment, the inlet arrangement 11 is bifurcated and has a first inlet 11*a* and a second inlet 11*b*. A compressed air feed hose (not shown) is connected to the first inlet 11*a*, while a compressed water feed hose (not shown) is connected to the second inlet 11*b*, so that air and water are introduced under pressure into the flow passage 10 of the apparatus body 1.

The inlet arrangement 11 may have a single inlet or more than two inlets. In case of the single inlet, different kinds of fluids may be mixed separately and then introduced under pressure into the single inlet. On the other hand, in case of more than two kinds of fluids, inlets may be provided according to the number of the fluid kinds, such as a first inlet, a second inlet, a third inlet, . . . Further, the fluid may be gas, liquid or fluidized solid, and the mixing may be carried out between fluids of the same phase or between fluids of different phases.

A downstream end of the flow passage 10 and thus the apparatus body 1 is closed by an end plate 12. The end plate 12 is disposed so as to be perpendicular to a center axis of the flow passage 1 in FIG. 1, but may also be inclined as will be described later.

The end plate 12 is formed with an injection or jet opening 13 at a position offset from the center axis of the flow passage 10 of the apparatus body 1 or offset from the center of the end plate 12. As long as the jet opening 13 is located at the offset position, there is no particular limitation to the shape and the number thereof. However, since the end plate 12 is used as a collision plate as will be explained later, if there are so many jet openings formed in the end plate 12, a function of the collision plate is lost. Thus, the number is limited up to several.

Figure 4:
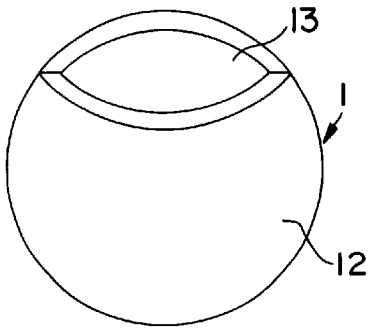
FIG. 4 is a left-side view of FIG. 1.

In this embodiment, the jet opening 13 is arranged as shown in FIG. 4, wherein the jet opening 13 has the shape of a convex lens and is formed at a peripheral portion of the end plate 12. The jet opening 13 may also be in the form of a cutout provided by cutting out a peripheral portion of the end plate 12.

Figures 5A, 5B, 5C, 5D:
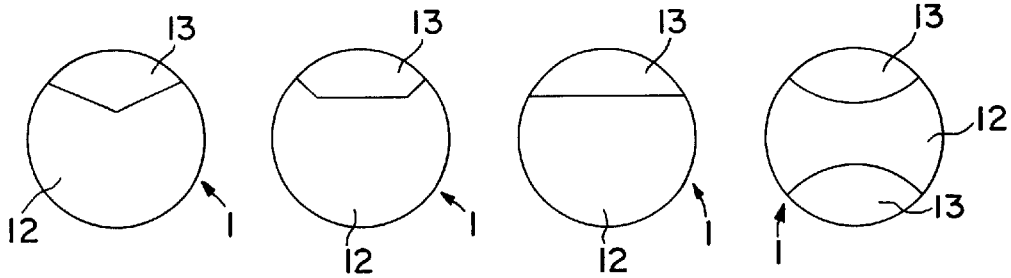
FIG. 5 is a diagram showing examples of end plates with jet openings.
Figures 5E, 5F, 5G, 5H:
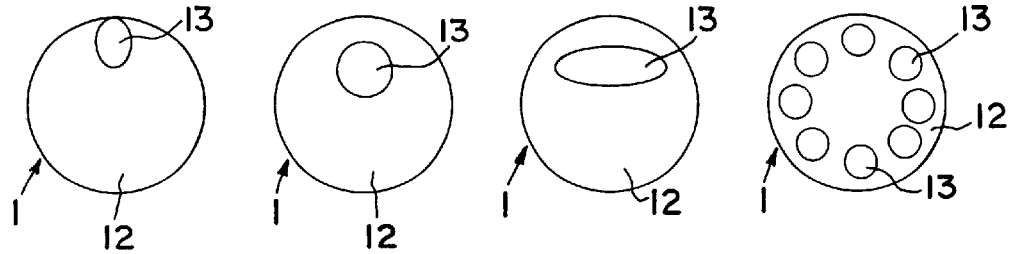

The jet opening/openings 13 may be arranged in various manners, for example, as shown at (A) to (H) in FIG. 5. At (A), the jet opening 13 is formed in V-shape at a peripheral portion of the end plate 12. At (B), the jet opening 13 is formed in the shape of a reversed-trapezoid at a peripheral portion of the end plate 12. At (C), the jet opening 13 is formed by a chord and a corresponding portion of the circumference of the end plate 12. At (D), a pair of jet openings 13 each having the shape of a convex lens are formed at peripheral portions of the end plate 12. At (E), the jet opening 13 is formed in the shape of a vertically elongate ellipse at a peripheral portion of the end plate 12. It has been confirmed through experiments that excellent mixing efficiencies can be obtained in the examples of (A) to (E).

Further, at (F), the jet opening 13 is formed in the shape of a circle at an offset position of the end plate 12. At (G), the jet opening 13 is formed in the shape of a transversely elongate ellipse at an offset position of the end plate 12. At (H), a plurality of jet openings 13 each having the shape of a circle are formed along the circumference of the end plate 12 at regular intervals. It has been confirmed through experiments that the examples of (F) to (H) are slightly smaller in mixing efficiency as compared with the examples of (A) to (E), but can improve the mixing efficiencies by approximately 1.2 to 1.5 times as compared with the foregoing conventional fluid mixing-jetting apparatus.

An operation of the fluid mixing-jetting apparatus according to this embodiment will be explained with reference to FIG. 1. The most part of fluids P1 and P2 introduced into the fluid passage 10 via the inlet arrangement 11 collides against the end plate 12. Then, the fluids P1 and P2 collided against the end plate 12 flow along an inner surface or an upstream surface of the end plate 12 so as to form the flow P3 directed toward the jet opening 13. Accordingly, near the upstream surface of the end plate 12, the fluids P1 and P2 collided against the upstream surface of the end plate 12 and the flow P3 directed toward the jet opening 13 are combined to form the turbulent flow so that agitation is effectively achieved.

The fluids introduced into the flow passage 10 via the inlet arrangement 11 are finally jetted out via the jet opening 13. In the conventional fluid mixing-jetting apparatus, since a jet outlet is located on the center axis of the flow passage 10 of the apparatus body 1, the fluids are jetted radially from the jet outlet. On the other hand, in this embodiment, since the jet opening 13 is located at the position offset from the center axis of the flow passage 10 of the apparatus body 1, differences in distance are generated even among the simultaneously introduced fluids to reach the jet opening 13. This generates differences in velocity to cause disturbance in radial jet flows P4, P4, P4, . . . so that the agitation is caused just after jetting-out of the fluids via the jet opening 13.

Further, the flow P3 directed toward the jet opening 13 is exerted upon the foregoing jet flows P4 so that the deflected turbulent flow P5 (meaning the turbulent flow in a direction different from those of the radial jet flows P4) is generated to cause collision of the jetted fluids against each other so as to further facilitate the mixing operation.

As appreciated from FIGS. 1 and 5, in the examples of (A) to (E), the jet opening 13 is in contact with or continuous with the inner circumference of the apparatus body 1 at the downstream end thereof. It has been confirmed through experiments that as the jet opening 13 offsets larger from the center axis of the flow passage 10 of the apparatus body 1, the mixing efficiency increases. For example, in the example of FIG. 4 wherein the jet opening 13 in the shape of a convex lens is formed at a peripheral portion of the end plate 12 so as to be continuous with the inner circumference of the apparatus body 1, the fluids flowing along the inner circumference of the apparatus body 1 and directly jetted out via the jet opening 13 are subjected to the least resistance, while the fluids collided against and guided a long way along the end plate 12 are subjected to much larger resistance. Therefore, the jet velocities largely differ from each other to further enhance a possibility of the jetted fluids to be mixed with each other. Since the difference in velocity increases as the jet opening 13 is located more offset from the foregoing center axis, it is preferable to not only locate the jet opening 13 at an offset position of the end plate 12, but also locate the jet opening 13 so as to be continuous with the inner circumference of the apparatus body 1.

It has also been confirmed through experiments that as the shape of the jet opening 13 deviates away from a circular, the mixing efficiency increases. Specifically, since the fluid jetting condition is more uniform in case of a circular jet opening as compared with a non-circular jet opening, the turbulent flow is reluctant to occur in case of the circular jet opening.

Figure 2:
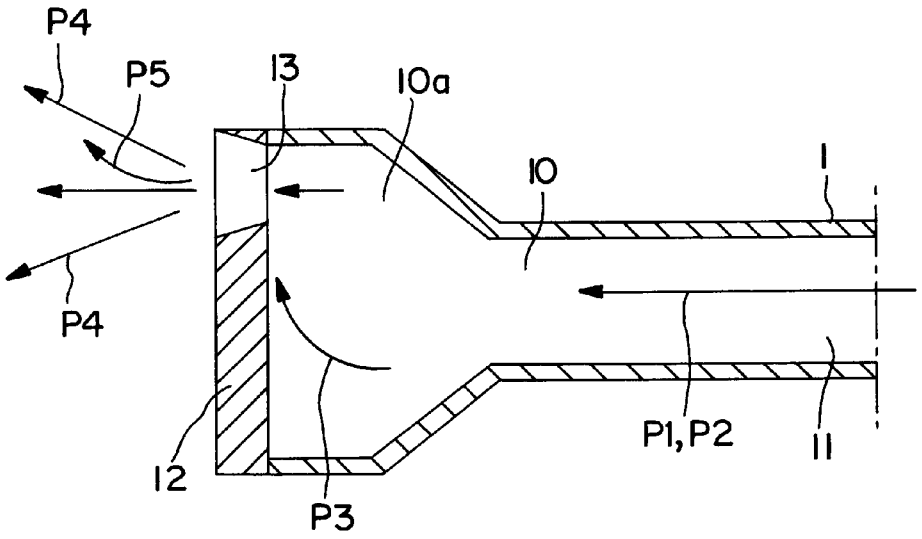
FIG. 2 is a longitudinal sectional view showing the main part of a fluid mixing-jetting apparatus according to a modification of the first preferred embodiment of the present invention.

According to a modification shown in FIG. 2, the end plate 12 is enlarged. Specifically, the flow passage 10 and thus the apparatus body 1 is increased in diameter to have a diameter-increased downstream end portion 10*a* at a downstream end portion thereof, and the end plate 12 is disposed to close a downstream open end of the diameter-increased portion 10*a*. By using the diameter-increased end plate 12, a function as a collision plate is enhanced.

Figure 3:
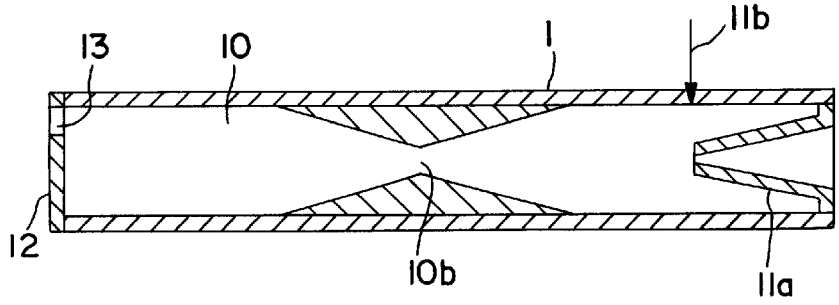
FIG. 3 is a longitudinal sectional view showing the main part of a fluid mixing-jetting apparatus according to another modification of the first preferred embodiment of the present invention.

According to another modification shown in FIG. 3, the first inlet 11*a* is in the form of a nozzle whose jet outlet is located at the center, in a diameter direction of the apparatus body 1, while the second inlet 11*b* is opened near the jet outlet of the first inlet 11*a*. Further, a narrowed passage portion 10*b* is provided in the flow passage 10 downstream of the first and second inlets 11*a* and 11*b*, so that an ejector arrangement is formed. Accordingly, mixing of the fluids is carried out to some extent through the ejector arrangement, and then the foregoing mixing operation is carried out.

Figure 8:
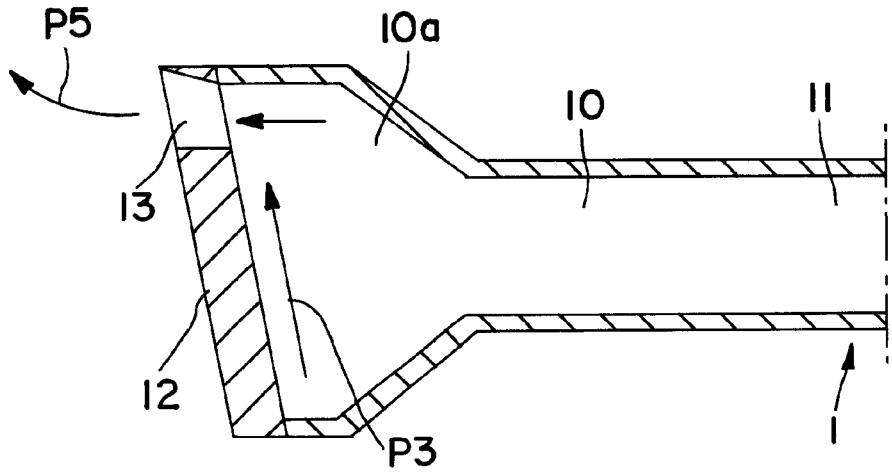
FIG. 8 is a longitudinal sectional view showing the main part of a fluid mixing-jetting apparatus according to another modification of the first preferred embodiment of the present invention.

According to another modification shown in FIG. 8, the end plate 12 is inclined in a downstream direction as it approaches an upper end thereof. With this arrangement, a pressure loss is reduced and further the flow P3 directed toward the jet opening 13 can be conducted more smoothly via the jet opening 13 in a direction different from the normal radial directions of the jetted fluids, so that the foregoing deflected turbulent flow P5 is intensified.

Figure 9:
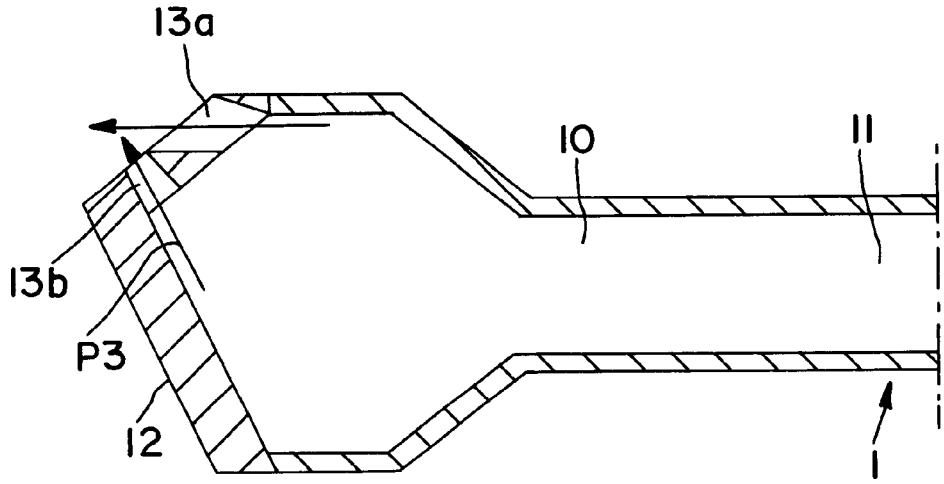
FIG. 9 is a longitudinal sectional view showing the main part of a fluid mixing-jetting apparatus according to another modification of the first preferred embodiment of the present invention.

According to another modification shown in FIG. 9, the end plate 12 has a first portion inclined in a downstream direction as it approaches an upper bent portion and a second portion inclined in an upstream direction as it approaches an upper end thereof away from the bent portion. Further, an auxiliary jet opening 13*b* directed along an upstream surface of the first portion is formed in the second portion just above the bent portion, and a main jet opening 13*a* directed along the center axis of the flow passage 10 is further formed in the second portion above the auxiliary jet opening 13*b*. With this arrangement, two jet flows having different jet directions via the main and auxiliary jet openings 13*a* and 13*b* securely collide with each other, so that the fluids can be effectively mixed just after the jetting out via the jet openings 13*a* and 13*b*.

Figure 6:
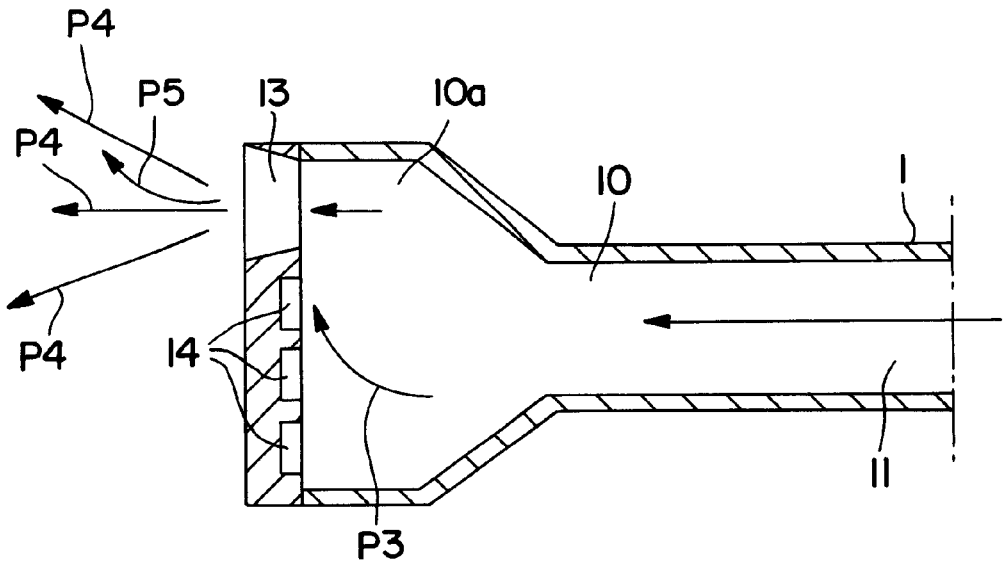
FIG. 6 is a longitudinal sectional view showing the main part of a fluid mixing-Jetting apparatus according to another modification of the first preferred embodiment of the present invention.
Figure 7:
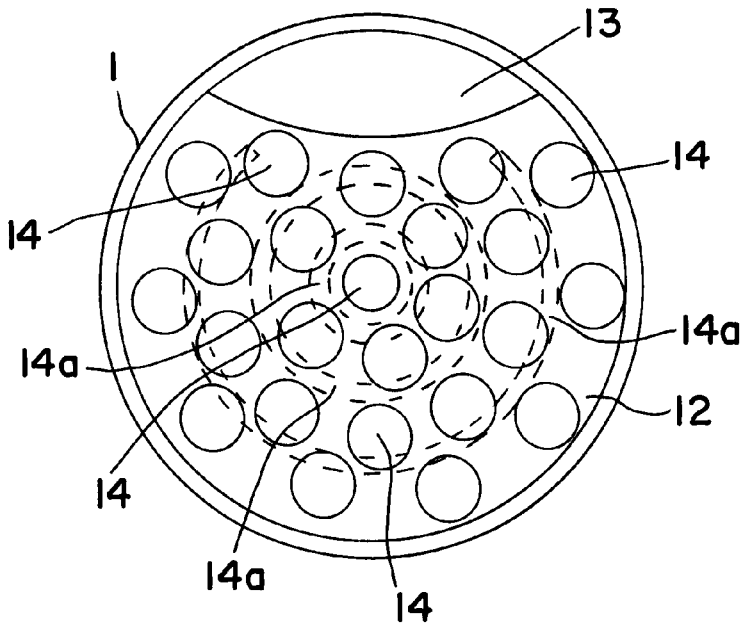
FIG. 7 is a front view of an end plate seen from a right side in FIG. 6.

According to a modification shown in FIGS. 6 and 7, the end plate 12 is formed with semispherical concave portions 14, 14, 14, . . . on an upstream surface thereof so that the upstream surface of the end plate 12 is formed as a non-planar surface. With this arrangement, the flow P3 along the end plate 12 and the flow collided against the end plate 12 are both guided by the serispherical concave portions 14 to produce small swirls which serve to effectively mix the fluids.

Instead of the semispherical concave portions 14, concentric grooves 14*a*, 14*a*, 14*a* as shown by broken lines in FIG. 7 or proper projections (not shown) may be formed on the upstream surface of the end plate 12.

Figure 10:
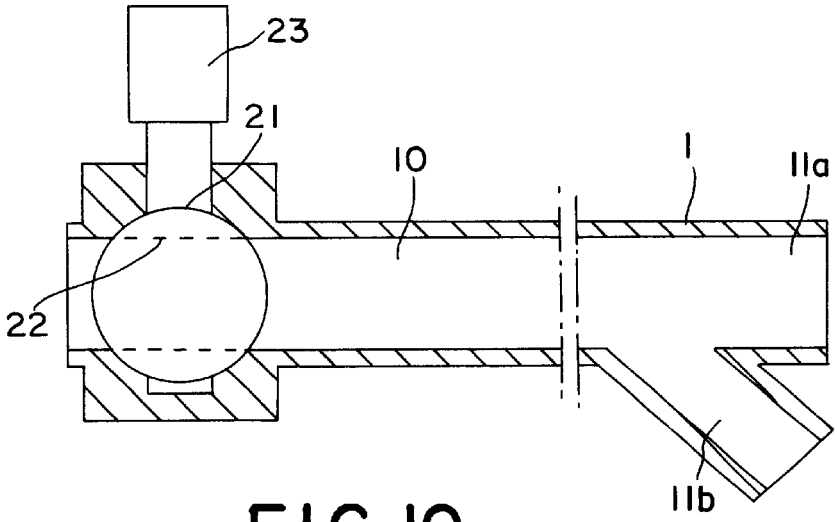
FIG. 10 is a longitudinal sectional view showing the main part of a fluid mixing-jetting apparatus according to another modification of the first preferred embodiment of the present invention.

According to another modification shown in FIG. 10, the end plate 12 and the non-circular jet opening 13 shown in FIG. 1 are realized by a ball valve, wherein a rotatable ball 21 is formed with a through hole 22 having the same diameter as the diameter of the flow passage 10. With this arrangement, by rotating the ball 21 using a driving source 23, such as a motor, to adjust a sectional area of an opening, an effect similar to that of the structure shown in FIG. 1 can be achieved. A gate valve may be used instead of the ball valve.

Figure 11:
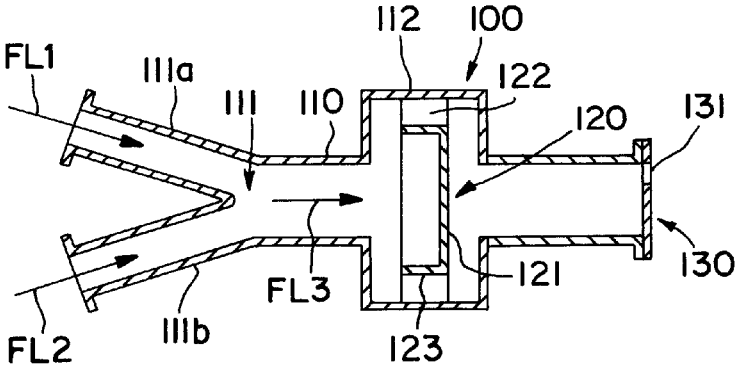
FIG. 11 is a longitudinal sectional view showing the main part of a fluid mixer according to a second preferred embodiment of the present invention.

Now, referring to FIG. 11, a fluid mixer according to the second preferred embodiment of the present invention will be described. In FIG. 11, the fluid mixer comprises an apparatus body 100. The apparatus body 100 is provided at its upstream end with an inlet arrangement 111 for introducing plural kinds of compressed fluids into a flow passage 110 formed in the apparatus body 100. The inlet arrangement 111 is bifurcated and has a first inlet 111*a* and a second inlet 111*b*. There is no particular difference in inlet arrangement between this embodiment and the foregoing first preferred embodiment shown in FIG. 1. Further, as in the foregoing modification of the first preferred embodiment, the inlet arrangement may be replaced with the ejector arrangement shown in FIG. 3. Further, there is also no particular difference in fluids to be used between this embodiment and the first preferred embodiment.

In the flow passage 110 of the apparatus body 100, a static mixer 120 is provided downstream of the inlet arrangement 111. As the static mixer 120, a twist vane type, a collision plate type or the like may be used. In this embodiment, the static mixer 120 of the collision plate type is used. Specifically, the flow passage 110 and thus the apparatus body 100 has a diameter-increased passage portion 112 in which a collision plate 121 is fixedly disposed such that the flow FL3 which is a mixture of the flow FL1 and the flow FL2 introduced under pressure via the first and second inlets 111*a* and 111*b* collides against the collision plate 121 perpendicularly. The collision plate 121 has a diameter no smaller than a diameter of the flow passage 110 upstream of the diameter-increased passage portion 112. The collision plate 121 is provided at its rim with a circumferential wall 123 projecting in a direction against the flow FL3, i.e, in an upstream direction. Thus, the flow FL3 after collision against the collision plate 121 is guided by the circumferential wall 123 in the upstream direction.

The collision plate 121 is fixed to the inner circumference of the diameter-increased passage portion 112 by radially arranged coupling vanes 122, 122, 122, . . . each of which is arranged in parallel with the flow direction or at a given twist angle relative to the flow direction. Even with the provision of the coupling vanes 122, the collision plate 121 and the circumferential wall 123, a sectional area of a flow passage in the diameter-increased passage portion 112 is, at any position thereof, set to be greater than a sectional area of the flow passage 110 upstream of the diameter-increased passage portion 112. With this arrangement, even if the intense turbulent/swirl flows are generated due to collision of the flow FL3 against the collision plate 121, the pressure loss can be suppressed as much as possible. As appreciated, the turbulent/swirl flows enhances agitation and mixing of the fluids forming the flow FL3.

In case the twist vane type static mixer is used instead of the collision plate type static mixer 120, if the diameter of the diameter-increased passage portion 112 is increased by more than reduction of a flow passage area caused by disposing the twist vane type static mixer in the diameter-increased passage portion 112, a pressure loss can be reduced although the agitation efficiency is somewhat lowered.

Since the collision plate type static mixer 120 is greater in mixing efficiency as compared with the twist vane type static mixer, the static mixer 120 is not necessarily disposed in the diameter-increased passage portion 112 if a later-described offset non-circular ejection opening 131 is provided to compensate for the pressure loss cooperatively with the static mixer 120.

Now, an operation of the collision plate 121 will be explained with reference to FIG. 13.

After colliding against the collision plate 121, the flow FL3 becomes radial flows P1 along the collision plate 121. Then, when approaching the circumferential wall 123, the radial flows P1 change their directions to a direction against the flow FL3 to become the flows P2 for getting over the circumferential wall 123. Thus, due to collision between the flows P2 and the flow FL introduced under pressure via the inlet arrangement 111, the intense turbulent flow is generated.

Instead of the flat disk shape, the collision plate 121 may have such a shape that a center portion of the collision plate 121 is projected in a direction of the flow FL3, or that a longitudinal section of the collision plate 121 has an approximately W-shape rotated by 90 degrees with a center portion thereof extending in a direction against the flow FL3. With this arrangement, the circumferential wall 123 may be omitted.

Figure 13:
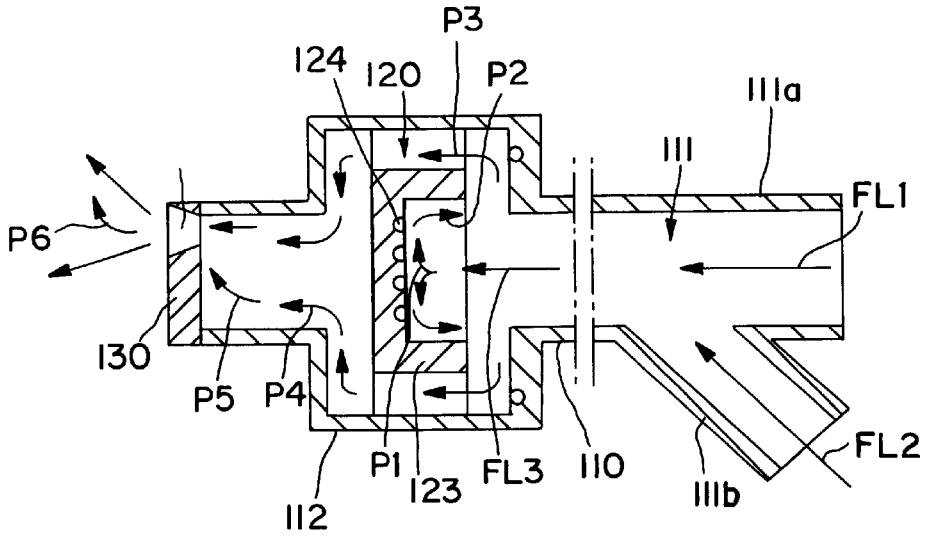
FIG. 13 is a longitudinal sectional view for explaining an operation of the fluid mixer shown in FIG. 11.

In the example of FIG. 13, a lot of semispherical concave portions 124, 124, 124, . . . are provided on an upstream surface of the collision plate 121 for further producing the turbulent/swirl flows to further enhance the agitation/mixing efficiency. There is no particular limitation to the shape of the concave portion 124. Further, the concave portions 124 may also be provided on the surfaces of the circumferential wall 123 and/or the inner circumference of the diameter-increased passage portion 112.

Then, the flows P2 getting over the circumferential wall 123 flow between the outer circumference of the circumferential wall 123 and the inner circumference of the diameter-increased passage portion 112 as shown by arrows P3, and then join each other downstream of the collision plate 121 as shown by arrows P4. Therefore, the flow directions change variously in the diameter-increased passage portion 112 so that the swirl/turbulent/collision flows are generated to securely agitate/mix the plural kinds of the fluids. Further, since the sectional area of the flow passage in the diameter-increased passage portion 112 is, at any position thereof, set greater than that of the flow passage 110 upstream of the diameter-increased passage portion 112, all the amount of the flow FL3 does not necessarily collide the collision plate 121, but a portion thereof directly flows in the directions of the arrows P3 to reduce the pressure loss.

As shown in FIGS. 11 and 13, a collision plate 130 closes a downstream end of the flow passage 110 downstream of the static mixer 120. The collision plate 130 is formed with a non-circular ejection opening 131 at a position offset from a center axis of the flow passage 110 or offset from the center of the collision plate 130. It may be arranged that the flow passage 110 downstream of the static mixer 120 is gradually reduced or increased in diameter with a downstream end thereof closed by the collision plate 130.

Figure 12:
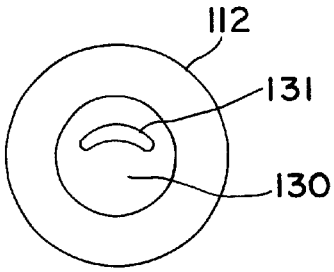
FIG. 12 is a right-side view of FIG. 11.

In this embodiment, the ejection opening 131 is as shown in FIG. 12. However, the ejection opening 131 may be arranged in various manners, for example, as shown at (A) to (H) in FIG. 5 in the foregoing first preferred embodiment.

Referring back to FIG. 13, the most part of the flow FL3 collided against the collision plate 121 and agitated/mixed in the diameter-increased passage portion 112 now collides against the collision plate 130 with the ejection opening 131 (a portion thereof may directly flow out via the ejection opening 131). Then, the fluids collided against the collision plate 130 flow along the collision plate 130 to become the flow P5, whereupon swirls are generated to agitate/mix the fluids again. Subsequently, since the ejection opening 131 is non-circular and located at the offset position, all the fluids ejected via the ejection opening 131 are not uniformly distributed in radial directions, and a portion thereof is ejected in a deflected direction as shown by an arrow P6. Thus, even after the ejection via the ejection opening 131, the fluids collide against each other to further implement agitation/mixing. Accordingly, the provision of the collision plate 130 significantly enhances the agitation/mixing efficiency of the fluid mixer.

In this embodiment, as shown in FIG. 11, a downstream side of the collision plate 130 is released, which is also applied to the example of FIG. 13. In this case, the mixed fluids are ejected via the ejection opening 131 of the collision plate 130 into a place of use or storage.

Figure 14:
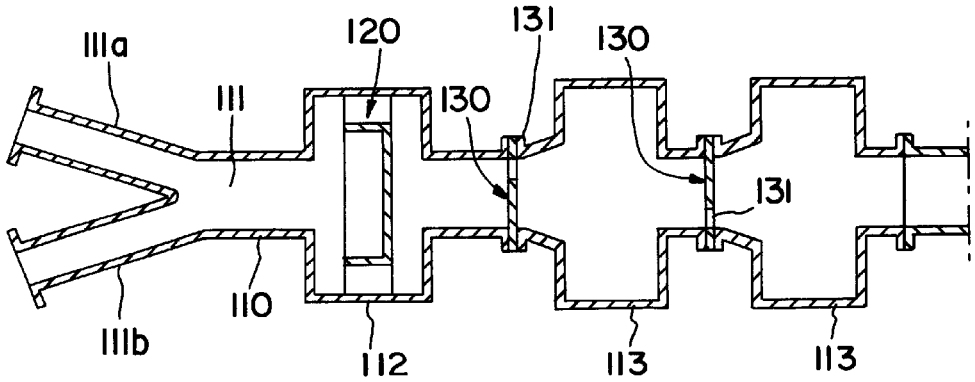
FIG. 14 is a longitudinal sectional view showing the main part of a fluid mixer according to a modification of the second preferred embodiment of the present invention.

On the other hand, according to a modification shown in FIG. 14, a downstream side of the collision plate 130, i.e. the flow passage 110, is extended to a given place. In this case, the flow passage 110 downstream of the collision plate 130 may have diameter-increased passage portions 113 with collision plates 130 interposed therebetween.

Figure 15:
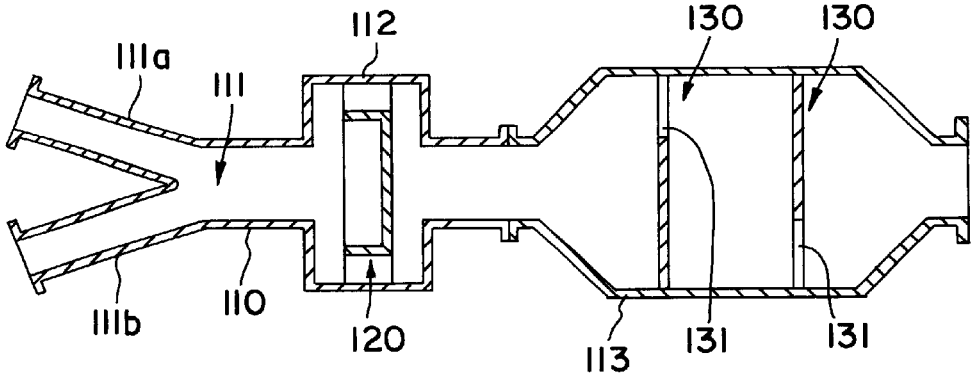
FIG. 15 is a longitudinal sectional view showing the main part of a fluid mixer according to another modification of the second preferred embodiment of the present invention.

According to another modification shown in FIG. 15, the flow passage 110 downstream of the diameter-increased passage portion 112 has a diameter-increased passage portion 113 extending over a given distance, which is provided therein with one or more collision plates 130. In this case, a pressure loss can be lowered, and further, a collision plate 130 with an ejection opening 131 whose sectional area is greater than that of the flow passage 110 at a portion thereof other than the diameter-increased passage portions can be disposed.

As appreciated from the foregoing description, the term "ejection opening" may cover the meaning ranging from "jet opening" used in the foregoing first preferred embodiment for jetting out the fluid mixture, to an outlet for discharging the fluid mixture in a non-jet manner. The former meaning may be applied to FIG. 11, 13 or 14, while the latter meaning may be applied to FIG. 15.

If the downstream side of the collision plate 130 is released or increased in diameter over a given distance in the flow direction, the pressure reduction occurs at the downstream side of the collision plate 130 so that the mixture fluids, for example, the gas-liquid mixture fluids, are divided so as to be finer. Further, the ejection opening 131 is non-circular so that the fluid ejection directions are diversified. Thus, the ejected fluids collide with each other so as to be agitated/mixed again. In the modification of FIG. 14, the high agitation/mixing efficiency after the fluid ejection can be expected. In the modification of FIG. 15, the reduction in pressure loss can be expected although the agitation/mixing efficiency is somewhat lowered.

Figure 16:
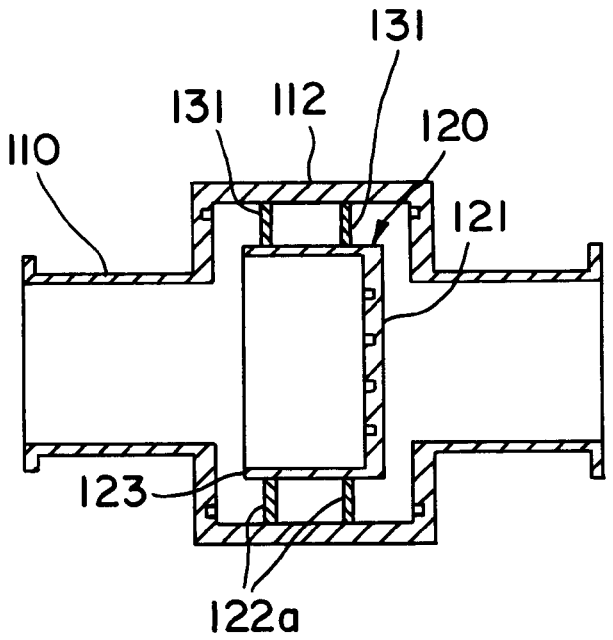
FIG. 16 is a longitudinal sectional view showing the main part of a fluid mixer according to another modification of the second preferred embodiment of the present invention.

According to another modification shown in FIG. 16, a pair of ring-shaped fixing disks 122*a*, 122*a* are provided between the outer circumference of the static mixer 120 and the inner circumference of the diameter-increased passage portion 112 so as to fix the static mixer 120 relative to the apparatus body 100. As opposed to the foregoing coupling vanes 122, each of the fixing disks 122*a* is disposed so as to close a flow passage in the diameter-increased passage portion 112. Each fixing disk 122*a* is formed with non-circular ejection openings 131 at positions offset toward an inner side or an outer side of the fixing disk 122*a*. In this modification, one of the fixing disks 122*a* is formed with the ejection openings 131 at the inner side thereof, while the other is formed with the ejection openings 131 at the outer side thereof. The number of the fixing disks 122*a* is not limited to two, but may be one or more than two.

Specifically, in this modification, the ejection opening 131 in FIG. 11 is formed in each fixing disk 122*a* so as to simply the structure. According to the results of experiments carried out by changing variously the total open areas of the ejection openings 131, although there are substantial pressure losses caused by narrowing the sectional area of the flow passage, improvement in mixing efficiency compensating for the pressure losses is confirmed. Accordingly, even if the static mixer 120 is not used in the state where the sectional area of the flow passage is increased, the arrangement is fully practical.

Figure 17:
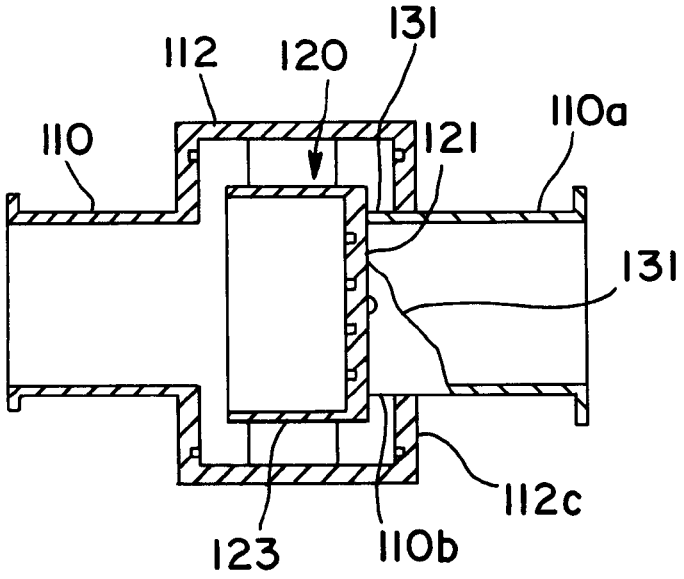
FIG. 17 is a longitudinal sectional view showing the main part of a fluid mixer according to another modification of the second preferred embodiment of the present invention.

According to another modification shown in FIG. 17, the flow passage 110 has a downstream passage portion 110*a* whose diameter is smaller than that of the diameter-increased passage portion 112 (If the diameter-increased passage portion 112 is not provided, the diameter of the downstream passage portion 110*a* is set to be smaller than that of the flow passage 110 upstream of the downstream passage portion 110*a*). The downstream passage portion 110*a* has an upstream extended portion 110*b*. The upstream extended portion 110*b* hermetically pass through an end plate 112*c* of the diameter-increased passage portion 112 to extend into the inside of the diameter-increased passage portion 112 and is hermetically closed at its upstream end by the collision plate 121. Further, the upstream extended portion 110*b* is formed with non-circular ejection openings 131, 131, 131, . . . at the upstream end thereof.

Specifically, in this modification, the ejection opening 131 in FIG. 11 is formed in the upstream extended portion 110*b* so as to simplify the structure. In this modification, a gap between the collision plate 121 and the end plate 112*c* forms a portion of the flow passage so that the fluids agitated/mixed by the static mixer 120 flow radially inward toward the upstream extended portion 110*b*. Therefore, the upstream end of the upstream extended portion 110*b* is offset from the middle points between the collision plate 21 and the end plate 112*c*. Accordingly, the ejection openings 131 are arranged at the offset positions between them.

Figure 18:
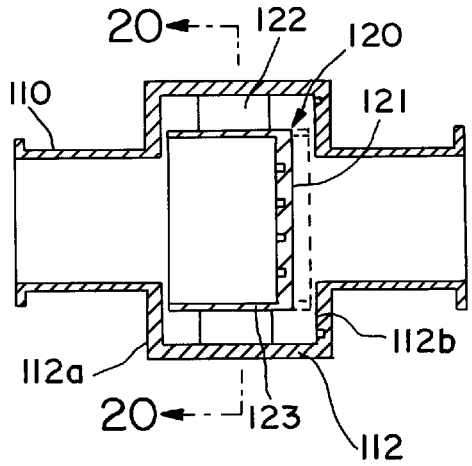
FIG. 18 is a longitudinal sectional view showing the main part of a fluid mixer according to another modification of the second preferred embodiment of the present invention.

According to another modification shown in FIG. 18, the diameter-increased passage portion 112 has a diameter-increasing step 112*a* where the portion 112 is increased in diameter and a diameter-decreasing step 112*b* where the portion 112 is reduced in diameter. The step 112*a* may be tapered to gradually increase the diameter of the portion 112, and the step 112*b* may also be tapered to gradually reduce the diameter of the portion 112. In this modification, an upstream end of the circumferential wall 123 is located close to the diameter-increasing step 112*a* to provide a small gap (0.2 mm to several millimeters) therebetween. This gap is used instead of the ejection opening 131 shown in FIG. 11. Specifically, relative to the flow FL3 collided against the collision plate 121 and guided along the circumferential wall 123, the gap works as an opening located at an offset position. Further, since the gap has the shape of an annular slit, it works as a non-circular opening.

Alternatively, a small gap may be formed between a downstream end of the circumferential wall 123 and the diameter-decreasing step 112*b* so as to work as the ejection opening 131. It may also be arranged that the circumferential wall 123 is also extended to a position downstream of the collision plate 121 as shown by broken line in FIG. 18 so as to provide small gaps between the upstream end of the circumferential wall 123 and the diameter-increasing step 112*a* and between the downstream end of the circumferential wall 123 and the diameter-decreasing step 112*b*.

Figure 19:
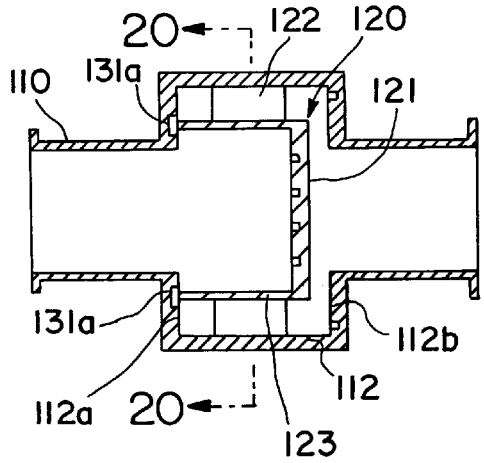
FIG. 19 is a longitudinal sectional view showing the main part of a fluid mixer according to another modification of the second preferred embodiment of the present invention.
Figure 20:
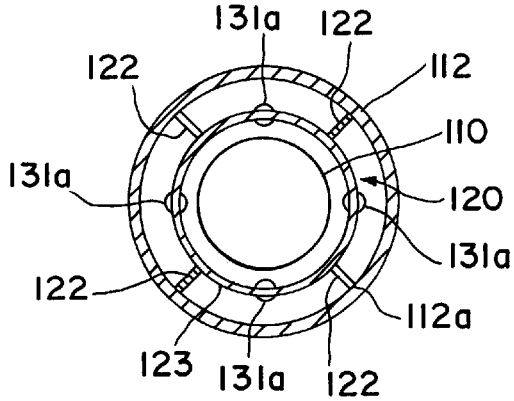
FIG. 20 is a sectional view taken along line A—A in FIG. 19.

According to another modification shown in FIGS. 19 and 20, an upstream end of the circumferential wall 123 is in contact with the diameter-increasing step 112*a*, and concave portions 131*a*, 131*a*, 131*a*, . . . are formed at regular intervals on the diameter-increasing step 112*a* at contact portions thereof with the circumferential wall 123 for establishing communication between upstream and downstream sides of the circumferential wall 123. In this modification, each concave portion 131*a* has a shallow cylindrical shape with a given depth. The diameter of each concave portion 131*a* is set greater than the thickness of the circumferential wall 123. Each concave portion 131*a* is located so that the concave portion 131*a* projects at both (upstream and downstream) sides of the circumferential wall 123. Accordingly, by adjusting the diameter and depth of the concave portion 131*a*, a small gap can be precisely obtained. As seen from FIG. 20, a portion of the concave portion 131*a* projecting at the downstream side of the circumferential wall 123 is crescent-shaped so that it works as a non-circular opening to improve the agitation/mixing efficiency. As compared with the foregoing modification shown in FIG. 18, a small gap can be easily obtained with high dimensional accuracy.

Alternatively, it may be arranged that a downstream end of the circumferential wall 123 is in contact with the diameter-decreasing step 112*b*, and concave portions 131*a*, 131*a*, 131*a*, . . . are formed at regular intervals on the diameter-decreasing step 112*b* at contact portions thereof with the circumferential wall 123 for establishing communication between upstream and downstream sides of the circumferential wall 123.

Figure 21:
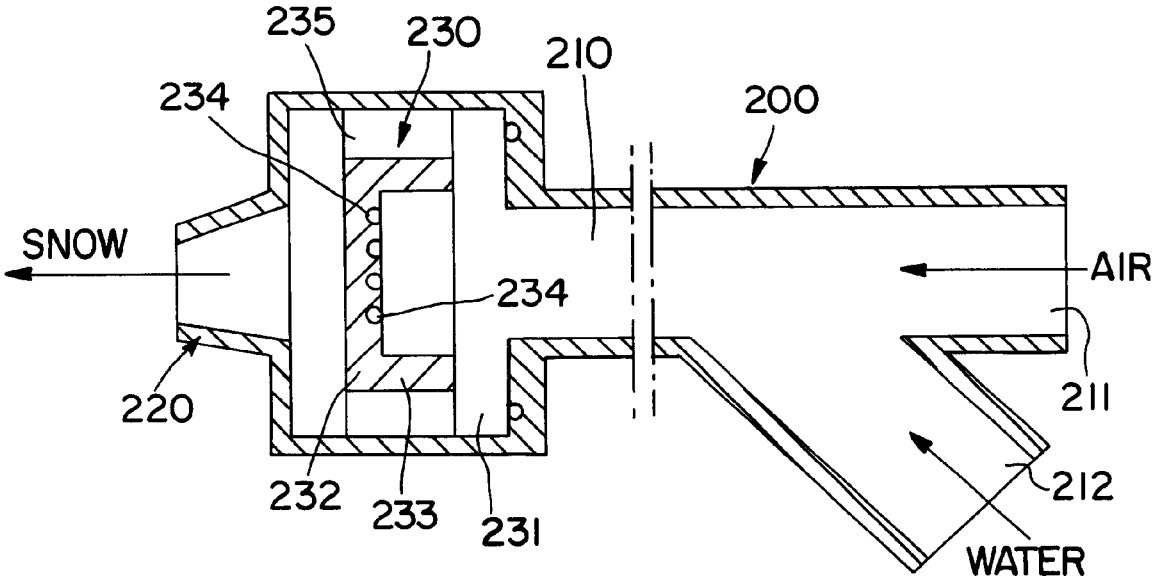
FIG. 21 is a longitudinal sectional view showing the main part of a snow gun type snowmaker according to a third preferred embodiment of the present invention.

Now, referring to FIG. 21, a snowmaker of a snow gun type according to the third preferred embodiment of the present invention will be described. In FIG. 21, the snowmaker comprises an apparatus body 200. The apparatus body 200 is provided at its upstream end with an inlet arrangement for introducing compressed air and water into a flow passage 210 formed in the apparatus body 200. Specifically, the inlet arrangement is bifurcated and has a first inlet 211 and a second inlet 212. A compressed air feed hose (not shown) is connected to the first inlet 211, while a compressed water feed hose (not shown) is connected to the second inlet 212, so that the compressed air and water are introduced into the flow passage 210 of the apparatus body 200.

In this embodiment, instead of the ejector structure employed in the foregoing conventional snowmaker, a static mixer 230 is provided in the flow passage 210 downstream of the inlet arrangement (211, 212). Further, in this embodiment, the static mixer 230 is of a collision plate type, which, however, may be replaced with a twist vane type or a ribbon screw type as will be described later.

The flow passage 210 and thus the apparatus body 200 has a diameter-increased passage portion 231 in which the static mixer 230 is concentrically disposed. The static mixer 230 comprises a collision plate 232 of a disk shape having a diameter approximate to that of the flow passage 210 upstream of the diameter-increased passage portion 231. The collision plate 232 is disposed perpendicular to a direction of the air-water mire flow, and provided with a circumferential wall 233 projecting from the rim of the collision plate 232 in a direction against the air-water mixture flow, i.e. in an upstream direction. A lot of semispherical concave portions 234, 234, 234, . . . are formed on an upstream surface of the collision plate 232. The static mixer 230 is fixed to the inner circumference of the diameter-increased passage portion 231 by radially arranged coupling vanes 235, 235, 235, . . . Even with the provision of the coupling vanes 235, the collision plate 232 and the circumferential wall 233, a sectional area of a flow passage in the diameter-increased passage portion 231 is, at any position thereof, set to be greater than a sectional area of the flow passage 210 upstream of the diameter-increased passage portion 231. With this arrangement, even if the intense turbulent/swirl flows are generated due to collision of the air-water mixture flow against the collision plate 232, the pressure loss can be suppressed as much as possible. As appreciated, the turbulent/swirl flows enhance agitation and mixing of the air and water contained in the mixture flow.

Instead of the flat disk shape, the collision plate 232 may have such a shape that a center portion of the collision plate 232 is projected in a direction of the mixture flow, or that a longitudinal section of the collision plate 232 has an approximately W-shape rotated by 90 degrees with a center portion thereof extending in a direction against the mature flow. With this arrangement, the circumferential wall 233 may be omitted.

The concave portions 234 are provided for further producing the turbulent/swirl flows to further enhance the agitation/mixing efficiency. There is no particular limitation to the shape of the concave portion 234.

An operation of the static mixer 230 in the diameter-increased passage portion 231 is essentially the same as the operation described in the second preferred embodiment with reference to FIGS. 11 and 13.

The air-water mixture having passed through the diameter-increased passage portion 231 is jetted out via a jet opening 220. Then, the pressure of the compressed air is released to divide jetted waterdrops so as to be further fined. In this case, if the air and water are fully mixed, the waterdrops are divided to be fined more uniformly. Further, when the pressure of the compressed air is released, the ambient area is cooled due to the adiabatic cooling effect. For example, when using the compressed air of 7 $Kg/cm^2$, a low temperature are of about −40° C. to −100° C. is obtained so that the jetted waterdrops are frozen thereby to produce artificial snow.

Conventionally, it has been considered that if the waterdrops are too small, frozen ice grains are likely to melt so that a given size is necessary to produce artificial snow which can fall down on the ground surface. Thus, conventionally, the waterdrops are not formed so small, but the amount of the compressed air is increased to ensure a larger area of lower temperatures.

However, the present inventor has found that only a small portion of jetted fine waterdrops is frozen due to the adiabatic cooling. After the jetting, those fine ice grains become nuclei to which simultaneously jetted waterdrops adhere so that ice grains of a given size is obtained for nuclei of snow. This phenomenon is the same as the natural snow producing mechanism. It has been confirmed that if the air-water mixing is securely performed, grains of the jetted liquid are more fined so that even if the amount of the compressed air is reduced by half, the excellent quality artificial snow is formed at an open air temperature of no higher than 2° C.

Accordingly, the static mixer 230 is used for uniformly mixing the air and water before jetting-out via the jet opening 220.

Figure 22:
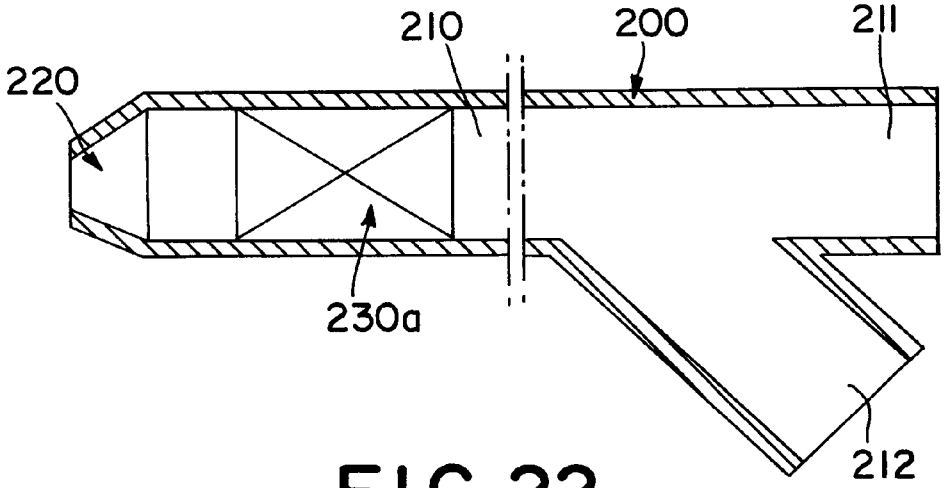
FIG. 22 is a longitudinal sectional view showing the main part of a snow gun type snowmaker according to a modification of the third preferred embodiment of the present invention.
Figure 23:
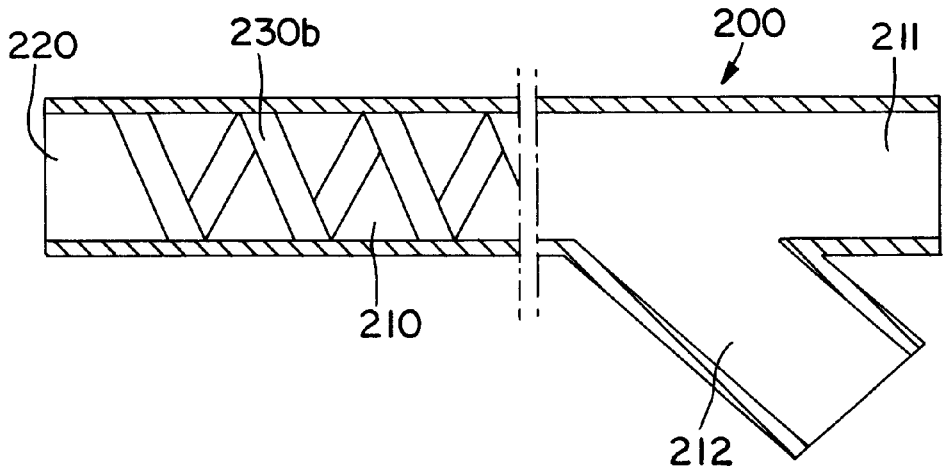
FIG. 23 is a longitudinal sectional view showing the main part of a snow gun type snowmaker according to another modification of the third preferred embodiment of the present invention.

As described above, the collision plate type static mixer 230 may be replaced with the twist vane type or the ribbon screw type, FIG. 22 shows a structure wherein a twist vane type static mixer 230*a* is provided in the flow passage 210. The twist vane type static mixer 230*a* is in the form of one or more plates each being twisted by 90 degrees or 180 degrees. FIG. 23 shows a structure wherein a ribbon screw type static mixer 230*b* is provided in the flow passage 210. The ribbon screw type static mixer 230*b* is in the form of a helical plate extending along the inner circumference of the apparatus body 200. Since pressure losses of the twist vane type static mixer 230*a* and the ribbon screw type static mixer 230*b* are smaller than that of the collision plate type static mixer 230, the diameter-increased passage portion 231 is not provided, but may be provided naturally.

Figure 24:
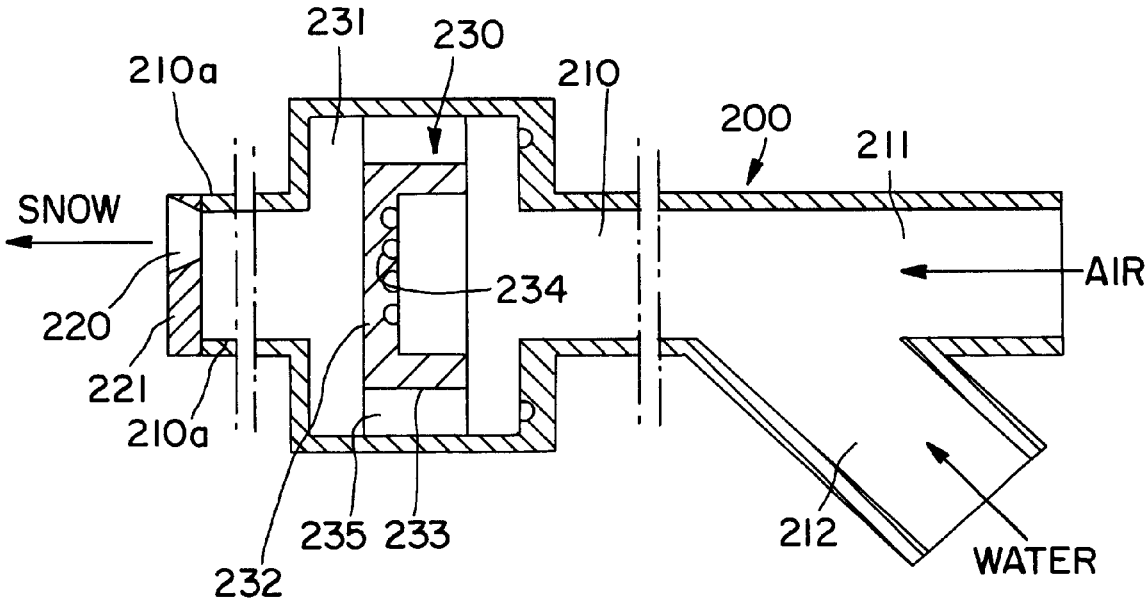
FIG. 24 is a longitudinal sectional view showing the main part of a snow gun type snowmaker according to another modification of the third preferred embodiment of the present invention.

According to a modification shown in FIG. 24, the flow passage 210 has a jet-side passage portion 210*a* downstream of the diameter-increased passage portion 231, The jet-side passage portion 210*a* has a diameter equal to that of the flow passage 210 upstream of the diameter-increased passage portion 231 and is closed by an end plate 221 at its downstream end. The end plate 221 is formed with a jet opening 220 at a position offset from the center axis of the flow passage 210.

Since an operation of this modification is essentially the same that of the structure shown in FIG. 13 with respect to the fluid flow directions and the fluid agitation/mixing operation, no further explanation thereof will be given for the brevity of description. As appreciated, even after the jetting-out via the jet opening 220, the fine waterdrops collide against each other to further implement agitation/mixing. Particularly, if the fine waterdrops collide against the frozen fine waterdrops in the adiabatic cooling area, a possibility is enhanced that they adhere to each other to grow ice grains.

As long as the jet opening 220 is located at the offset position of the end plate 221, there is no particular limitation to the shape and the number thereof. However, since the end plate 221 is used as a collision plate, if there are so many jet openings formed in the end plate 221, a function of the collision plate is lost. Thus, the number is limited up to several.

In this modification, the jet opening 220 is arranged like the jet opening 13 as shown in FIG. 4. However, the jet opening 220 may be arranged in various manners, for example, as shown at (A) to (H) in FIG. 5 in the foregoing first preferred embodiment. It has been confirmed through experiments that the amount of the compressed air to be used can be considerably reduced in the examples of FIG. 5 while the examples of (A) to (E) are more effective as compared with the examples of (F) to (H).

Figure 25:
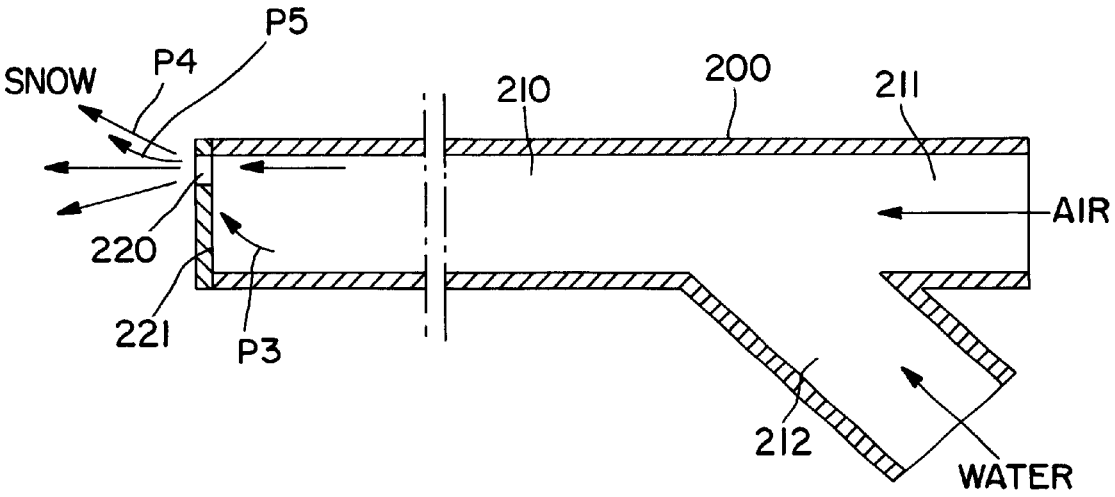
FIG. 25 is a longitudinal sectional view showing the main part of a snow gun type snowmaker according to another modification of the third preferred embodiment of the present invention.

According to another modification shown in FIG. 25, the static mixer 230 is omitted from the modification of FIG. 24. Since an operation of this modification is essentially the same as that of the structure shown in FIG. 1 with respect to the fluid flow directions and the fluid agitation/mixing operation, no further explanation thereof will be given for the brevity of description. Even with the structure in this modification, the snow producing efficiency can be improved as compared with the foregoing conventional snowmaker.

Figure 26:
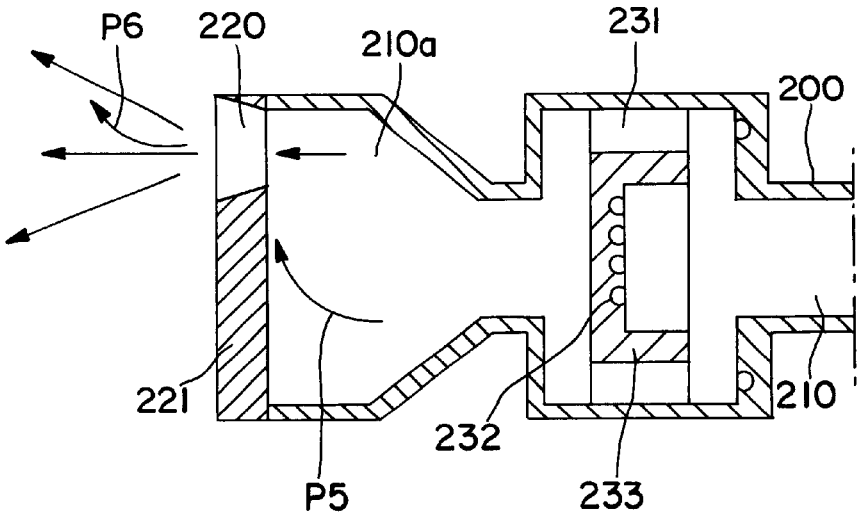
FIG. 26 is a longitudinal sectional view showing the main part of a snow gun type snowmaker according to another modification of the third preferred embodiment of the present invention.

According to another modification shown in FIG. 26, the jet-side passage portion 210*a* shown in FIG. 24 is enlarged in diameter. Specifically, in this modification, the diameter of the jet-side passage portion 210*a* is set greater than that of the flow passage 210 upstream of the diameter-increased passage portion 231. With this arrangement, since the diameter of the end plate 221 is also enlarged in diameter, the jet opening 220 can be more offset so that the agitation/mixing efficiency can be further improved.

It may be arranged that the jet-side passage portion 210*a* shown in FIG. 26 may be located offset from the center axis of the flow passage 210.

Figure 27:
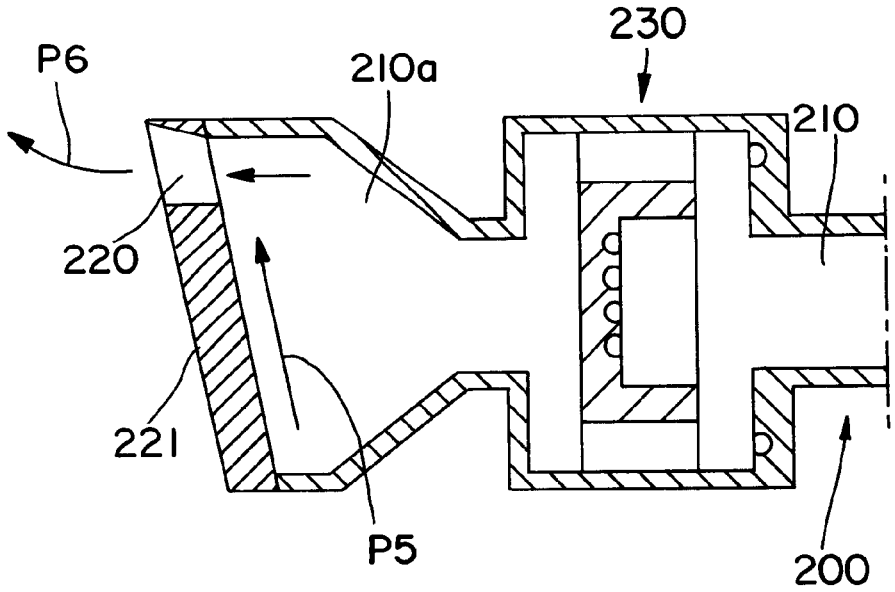
FIG. 27 is a longitudinal sectional view showing the main part of a snow gun type snowmaker according to another modification of the third preferred embodiment of the present invention.

According to another modification shown in FIG. 27, the end plate 221 is inclined in a downstream direction as it approaches an upper end thereof. Since this inclined arrangement of the end plate is essentially the same as that shown in FIG. 8, no further explanation thereof will be given for the brevity of description.

Figure 28:
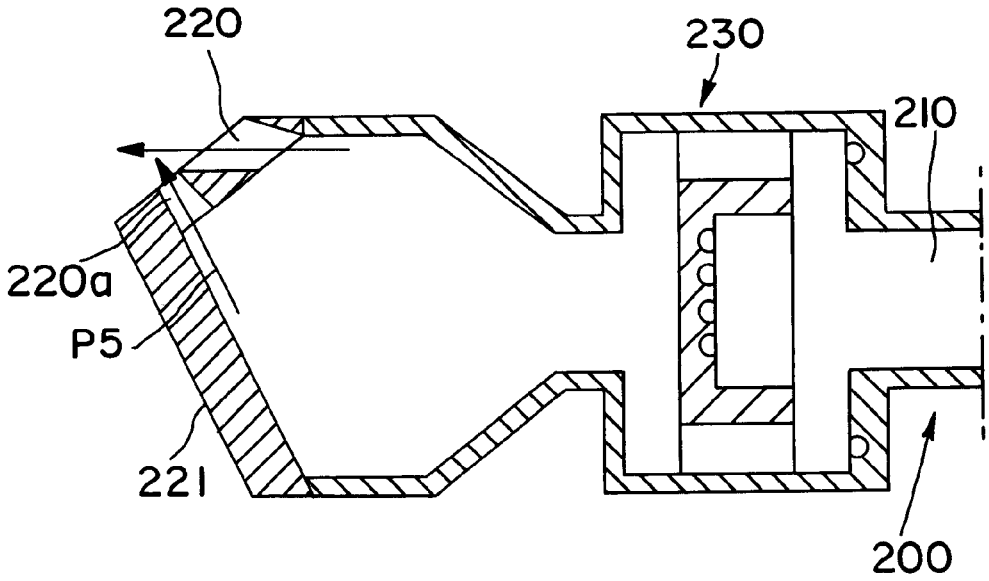
FIG. 28 is a longitudinal sectional view showing the main part of a snow gun type snowmaker according to another modification of the third preferred embodiment of the present invention.

According to another modification shown in FIG. 28, the end plate 221 has a first portion inclined in a downstream direction as it approaches an upper bent portion and a second portion inclined in an upstream direction as it approaches an upper end thereof away from the bent portion. Further, an auxiliary jet opening 220*a* directed along an upstream surface of the first portion is formed in the second portion just above the bent portion, and a main jet opening 220 directed along the center axis of the flow passage 210 is further formed in the second portion above the auxiliary jet opening 220*a*. Since this bent arrangement of the end plate is essentially the same as that shown in FIG. 9, no further explanation thereof will be given for the brevity of description.

Figure 29:
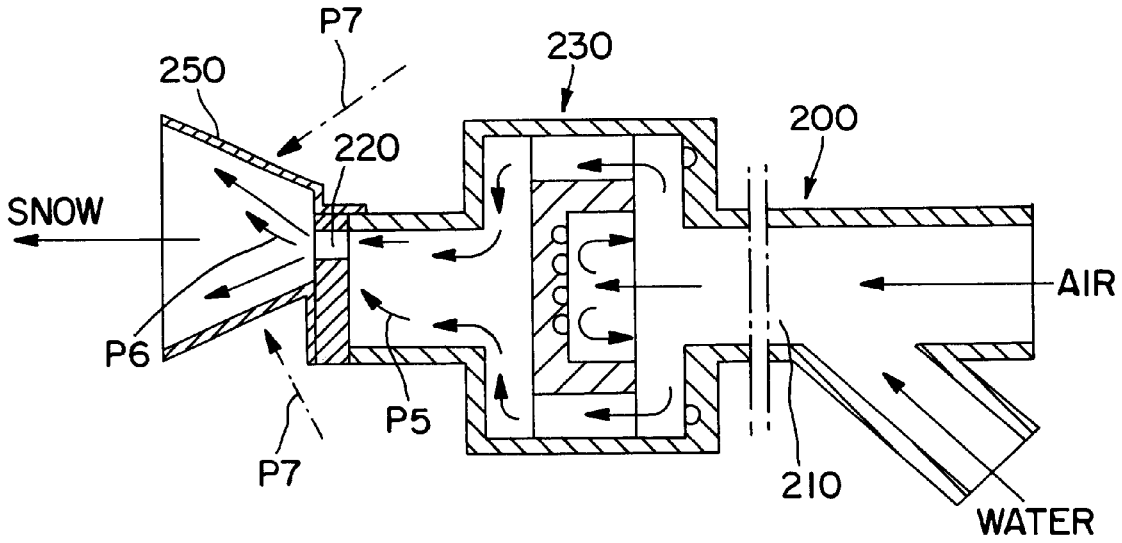
FIG. 29 is a longitudinal sectional view showing the main part of a snow gun type snowmaker according to another modification of the third preferred embodiment of the present invention.

According to another modification shown in FIG. 29, an open-air suction inhibiting cover 250 of a funnel shape is provided around the jet opening 220 so as to be opened in a jet direction of the air-water mixture via the jet opening 220. The cover 250 is fixed to the end plate 221 shown in FIG. 24. The pressure is lowered in inverse proportion to the velocity of the fluid flow jetted vie the jet opening 220 (Bernoulli's theorem). Accordingly, in case of the snow gun type snowmaker, the open air about twice the jetted water in volume ratio is normally sucked in just after jetting-out of the air-water mixture via the jet opening 220. Thus, even if the adiabatic cooling of −40° C. is achieved, it is largely canceled by the high-temperature open air so that the cooling efficiency is lowered. In view of this, the cover 250 is provided around the jet opening 220 to prevent suction of the open air which impedes the adiabatic cooling. It is necessary that the cover 250 is disposed so as not to substantially impede the jetting-out of the air-water mixture, the deflected turbulent flow and the pressure release of the compressed air.

Even if only the cover 250 is attached to the foregoing conventional snowmaker, the amount of the compressed air to be used can be reduced by about 1/10.

Figure 30:
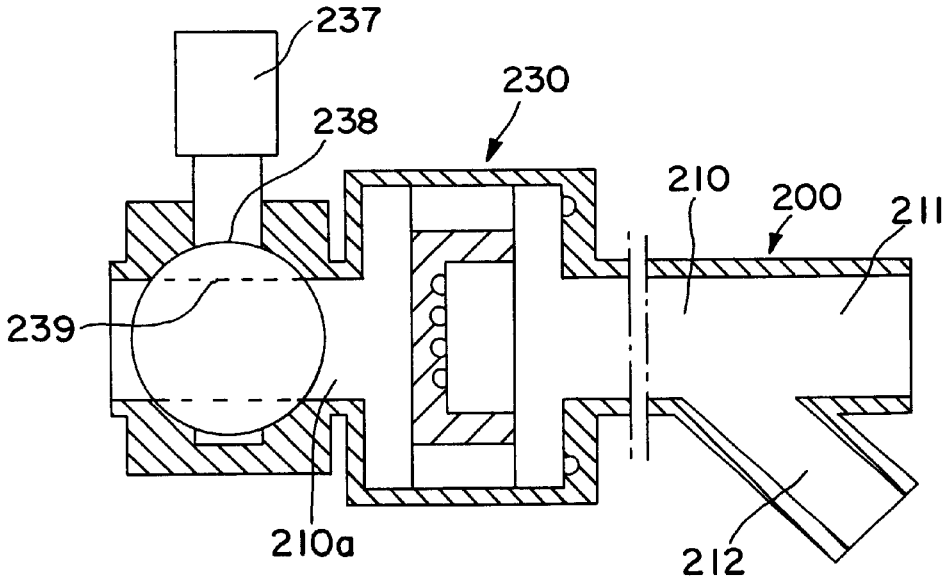
FIG. 30 is a longitudinal sectional view showing the main part of a snow gun type snowmaker according to another modification of the third preferred embodiment of the present invention.

According to another modification shown in FIG. 30, the end plate 221 and the non-circular jet opening 220 shown in FIG. 24 are realized by a ball valve, wherein a rotatable ball 238 is formed with a through hole 239 having the same diameter as the diameter of the jet-side passage portion 210*a*. With this arrangement, by rotating the ball 238 using a driving source 237, such as a motor, to adjust a sectional area of an opening, an effect similar to that of the structure shown in FIG. 24 can be achieved. A gate valve may be used instead of the ball valve.

Figure 31:
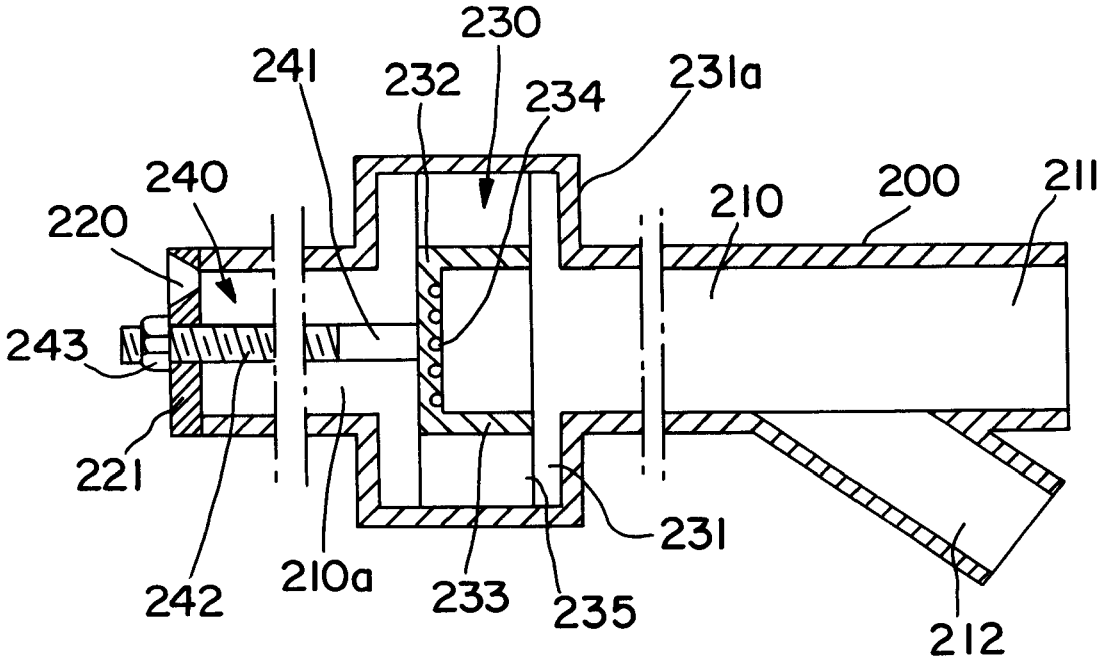
FIG. 31 is a longitudinal sectional view showing the main part of a snow gun type snowmaker according to another modification of the third preferred embodiment of the present invention.

According to another modification shown in FIG. 31, the static mixer 230 comprising the collision plate 232 and the circumferential wall 233 shown in FIG. 24 are arranged to be movable within the diameter-increased passage portion 231 along the center axis of the flow passage 210. Specifically, each of the coupling vanes 235 is fixed to the outer circumference of the circumferential wall 233 while slidable on the inner circumference of the diameter-increased passage portion 231. In this modification, guide grooves are formed on the inner circumference of the diameter-increased passage portion 231 and the coupling vanes 235 are slidably engaged with the corresponding guide grooves, respectively.

A collision plate moving mechanism 240 is arranged at a downstream side of the collision plate 232 for moving the collision plate 232 so as to adjust a gap between an upstream end of the circumferential wall 233 and an upstream diameter-increasing step 231*a* of the diameter-increased passage portion 231.

The collision plate moving mechanism 240 comprises an operating rod 241 having a screwed outer circumference 242 and a screwed hole formed at the center of the end plate 221. The operating rod 241 is inserted through the screwed hole and fixed to the collision plate 232. With this arrangement, the operating rod 241 is advanced or retreated through rotation thereof so as to adjust the gap between the upstream end of the circumferential wall 233 and the upstream diameter-increasing step 231*a*.

In this modification, the adjustment of the gap is set in the range of about 10 mm to about 0 mm. It is preferable to avoid tight contact between the upstream end of the circumferential wall 233 and the upstream diameter-increasing step 231*a*. It may be arranged that some fluid communication is ensured via grooves or the like even in case of the tight contact therebetween. If the gap is reduced, a pressure loss is increased to require higher power for transferring the air and water under pressure, while the mixing efficiency of the air and water is improved. Accordingly, when the gap is reduced, even if the open air temperature is relatively high, it is possible to produce snow.

As long as the foregoing gap can be adjusted, the collision plate moving mechanism is not limited to the foregoing structure.

Figure 32:
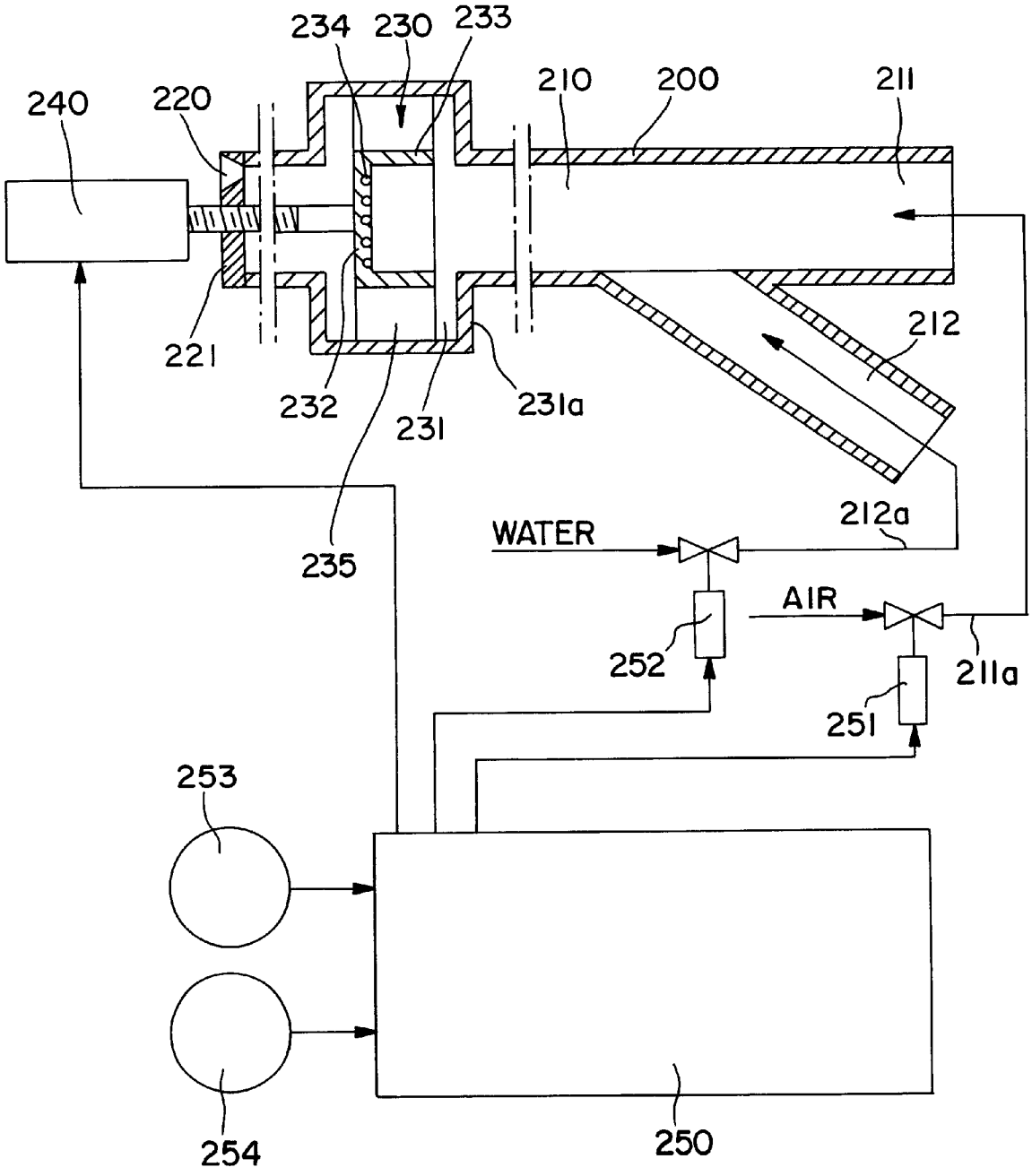
FIG. 32 is a longitudinal sectional view showing the main part of a snow gun type snowmaker according to another modification of the third preferred embodiment of the present invention.

According to another modification shown in FIG. 32, a compressed air feed amount adjusting apparatus 251 and a compressed water feed amount adjusting apparatus 252 are further provided in the structure shown in FIG. 31.

Specifically, in this modification, the snow production matching the open air condition can be achieved by adjusting the foregoing gap, the compressed air feed amount and the compressed water feed amount.

Although the apparatuses 251 and 252 are shown in FIG. 32 in the form of valves for simplification, these apparatuses actually adjust the feed amounts by adjusting the speed of compressors in the known manner.

In FIG. 32, numeral 211*a* denotes a compressed air feed hose connected to the first inlet 211, while numeral 212*a* denotes a compressed water feed hose connected to the second inlet 212.

If the open air temperature is low so that snow can be easily produced, the foregoing gap is increased the compressed water feed amount is increased and the compressed air feed amount is reduced. Since the feeding of the compressed air most consumes the power in the snow gun type snowmaker, it is economically effective that a large amount of snow can be produced with less power. On the other hand, if the open air temperature is high so that snow can not be easily produced, the foregoing gap is reduced, the compressed water feed amount is reduced and the compressed air feed amount is increased. In this case, the large power is required while the production amount of snow is reduced. However, snow can be produced at an open air temperature up to about 2° C. to about 4° C.

In this modification, the foregoing adjustment is automatically carried out. For this purpose, there are further provided an open air temperature gauge 253, an open air hygrometer 254 (if humidity is high, it is difficult to produce snow of good quality), and a controller 250 which controls the collision plate moving mechanism 240, the compressed air feed amount adjusting apparatus 251 and the compressed water feed amount adjusting apparatus 252 based on measured values of the temperature gauge 253 and the hygrometer 254.

In this modification, the collision plate moving mechanism 240 includes an apparatus for rotating the operating rod 241. Based on signals from the controller 250, the collision plate moving mechanism 240 and the apparatuses 251 and 252 are operated to achieve the optimum snow production. In this modification, the controller 250 stores numerical data representing experienced rules and, by comparing a measured temperature and a humidity with the past examples, the optimum condition is searched out. On the other hand, a calculation equation may be obtained and used for deriving an adjusting condition.

While the present invention has been described in terms of the preferred embodiments, the invention is not to be limited thereto, but can be embodied in various ways without departing from the principle of the invention as defined in the appended claims.

What is claimed is:

1. A fluid mixer comprising:

an apparatus body provided at its upstream end with an inlet arrangement for introducing plural kinds of fluids into a flow passage which is formed in said apparatus body and extends from said inlet arrangement toward a downstream end thereof, said flow passage having a diameter-increased passage portion with its sectional area greater than a sectional area of said flow passage upstream of said diameter-increased passage portion;

a static mixer provided in said diameter-increased passage portion of the flow passage for mixing the fluids introduced via said inlet arrangement, said static mixer comprising a collision plate disposed perpendicular to a flow direction of the fluids and a circumferential wall projecting in an upstream direction from a rim of said collision plate; and a moving mechanism for moving said static mixer to adjust a gap between an upstream end of said circumferential wall and an upstream diameter-increasing step of said diameter-increased passage portion.

2. The fluid mixer according to claim 1, wherein said moving mechanism moves said static mixer along a center axis of said flow passage to adjust said gap.

3. The fluid mixer according to claim 2, wherein a plurality of coupling vanes are fixed to an outer circumference of said circumferential wall, and a plurality of guide grooves are formed on an inner circumference of said diameter-increased passage portion, and wherein said coupling vanes slidably engage the corresponding guide grooves, respectively.

4. The fluid mixer according to claim 2, wherein said downstream end of the flow passage is closed by an end plate having an opening for discharging the fluids therethrough, said opening located at a position offset from the center axis of said flow passage.

5. The fluid mixer according to claim 4, wherein said moving mechanism comprises an operating rod having a screwed outer circumference and a screwed hole formed at the center of said end plate, and wherein said operating rod is inserted through said screwed hole and fixed to the collision plate of said static mixer, so that said operating rod is advanced or retreated through rotation thereof to adjust said gap.

6. The fluid mixer according to claim 4, wherein said opening is non-circular.

7. The fluid mixer according to claim 6, wherein said opening is elliptic.

8. The fluid mixer according to claim 6, wherein said opening is continuous with an inner circumference of said apparatus body.

9. The fluid mixer according to claim 1, wherein said collision plate is formed with a plurality of concave portions on an upstream surface thereof.

10. The fluid mixer according to claim 1, wherein the fluid mixer is used for a snowmaker, and wherein the fluids are compressed air and water.

11. The fluid mixer according to claim 10, further comprising a compressed air feed amount adjusting apparatus for adjusting an amount of the compressed air to be introduced into said flow passage via said inlet arrangement, and a compressed water feed amount adjusting apparatus for adjusting an amount of the compressed water to be introduced into said flow passage via said inlet arrangement.

12. The fluid mixer according to claim 11, further comprising an open air temperature gauge, an open air hygrometer and a controller which controls said moving mechanism, said compressed air feed amount adjusting apparatus and said compressed water feed amount adjusting apparatus based on measured values of said open air temperature gauge and said open air hygrometer.

* * * * *